US009959732B2

(12) United States Patent
Xu et al.

(10) Patent No.: US 9,959,732 B2
(45) Date of Patent: May 1, 2018

(54) METHOD AND SYSTEM FOR FALL DETECTION

(71) Applicant: Micron Electronics LLC, Boca Raton, FL (US)

(72) Inventors: Jun Xu, Boca Raton, FL (US); Ping Cheng, Boca Raton, FL (US)

(73) Assignee: MICRON ELECTRONICS LLC, Boca Raton, FL (US)

( * ) Notice: Subject to any disclaimer, the term of this patent is extended or adjusted under 35 U.S.C. 154(b) by 0 days. days.

(21) Appl. No.: 15/299,313

(22) Filed: Oct. 20, 2016

(65) Prior Publication Data

US 2017/0109990 A1 Apr. 20, 2017

Related U.S. Application Data

(60) Provisional application No. 62/243,738, filed on Oct. 20, 2015.

(51) Int. Cl.
*G08B 21/04* (2006.01)

(52) U.S. Cl.
CPC ..... *G08B 21/043* (2013.01); *G08B 21/0446* (2013.01); *G08B 21/0469* (2013.01)

(58) Field of Classification Search
CPC ..... G08B 21/02; G08B 21/0211; G08B 21/0225; G08B 21/0236; G08B 21/043; G08B 21/0446; G08B 21/0453; G08B 21/0469; G08B 25/016; G08B 25/10
USPC ..... 340/539.11, 539.12, 522, 506, 573.1; 600/300, 301; 128/903, 904
See application file for complete search history.

(56) References Cited

U.S. PATENT DOCUMENTS 9,261,527 B2 * 2/2016 Lin ..... A61B 5/1117
2010/0298656 A1 * 11/2010 McCombie ..... A61B 5/0205 600/301
2011/0025493 A1 * 2/2011 Papadopoulos .... A61B 5/02427 340/539.12
2011/0316702 A1 * 12/2011 Chuang ..... G08B 21/0446 340/573.1
2014/0235979 A1 * 8/2014 Banet ..... A61B 5/02028 600/324
2014/0327540 A1 * 11/2014 Shin ..... G08B 21/0446 340/539.11
2015/0100245 A1 * 4/2015 Huang ..... A61B 5/0022 702/19

(Continued)

*Primary Examiner* — Hung T Nguyen
(74) *Attorney, Agent, or Firm* — Anova Law Group, PLLC

(57) ABSTRACT

The present disclosure provides a method and a system for fall detection. Measurement signals are received from a plurality of sensors to monitor user activities, the plurality of sensors including a motion sensor for collecting motion information and a biomedical sensor for collecting physiological information. According to a signal processing sequence, whether the measurement signals meet multiple qualifying conditions for a fall incident is determined. The multiple qualifying conditions include: a condition evaluating at least the motion information, and a condition evaluating at least the physiological information. The method further includes: when the measurement signals do not meet the multiple qualifying conditions, continuing to monitor the user activities; and when the measurement signals meet the multiple conditions, determining that a fall incident has occurred, and sending an alert message to a designated contact.

19 Claims, 8 Drawing Sheets

(56) References Cited

U.S. PATENT DOCUMENTS

| | | | | |
|---|---|---|---|---|
| 2015/0181314 | A1* | 6/2015 | Swanson | H04Q 9/00<br>340/870.07 |
| 2015/0294551 | A1* | 10/2015 | Edwards | A61M 5/31<br>340/635 |
| 2015/0317890 | A1* | 11/2015 | Ten Kate | A61B 5/1117<br>702/141 |

* cited by examiner

400

Static X/Y/Z Output Response versus Orientation to Earth's surface (1g):

GSEL1=0, GSEL0=0 (± 2g)

| Position | 1 | 2 | 3 | 4 | 5 | 6 |
|---|---|---|---|---|---|---|
| Diagram | | | | | Top / Bottom | Bottom / Top |
| Resolution (bits) | 12 8 | 12 8 | 12 8 | 12 8 | 12 8 | 12 8 |
| X (counts) | 1024 64 | 0 0 | -1024 -64 | 0 0 | 0 0 | 0 0 |
| Y (counts) | 0 0 | 1024 -64 | 0 0 | 1024 64 | 0 0 | 0 0 |
| Z (counts) | 0 0 | 0 0 | 0 0 | 0 0 | 1024 64 | -1024 -64 |
| X-Polarity | + | 0 | - | 0 | 0 | 0 |
| Y-Polarity | 0 | - | 0 | + | 0 | 0 |
| Z-Polarity | 0 | 0 | 0 | 0 | + | - |

(1g)

Earth's Surface

FIG. 10

METHOD AND SYSTEM FOR FALL DETECTION

CROSS-REFERENCES TO RELATED APPLICATIONS

This application claims the priority of U.S. Provisional Application No. 62/243,738, entitled "A system and method for reducing false alert in fall detection applications", filed on Oct. 20, 2015, the entire contents of which is incorporated herein by reference.

FIELD OF THE DISCLOSURE

The present disclosure relates to the field of smart device technologies and, more particularly, relates to a method and system for fall detection.

BACKGROUND

Fall detection addresses an important public health problem, especially among the elderly. Traditionally, fall detection applications are broadly categorized into two types: context-aware systems and wearable devices. The context-aware systems use sensors such as cameras, floor sensors and microphones deployed in certain environment to detect falls of people who enter the monitored environment. The wearable devices are miniature electronic sensor-based devices worn by a bearer/subject under, with or on top of clothing. The vast majority of wearable fall detectors adopt the form of accelerometer devices, or a combination of accelerometer and other sensors such as a tilt sensor or gyroscopes to obtain information about the position of the subject.

A common feature of both types of fall detection applications is the reliance on mechanical signals of the movement or change of movement to assess the occurrence of a fall event. A major factor limiting the usefulness of existing motion-based fall detection applications is high rate of false alerts, which are resulted from poor performance of the devices in discriminating normal living activities from true fall events.

The disclosed method and system are directed to solve one or more problems set forth above and other problems.

BRIEF SUMMARY OF THE DISCLOSURE

One aspect of the present disclosure provides a method for fall detection. Measurement signals are received from a plurality of sensors to monitor user activities, the plurality of sensors including a motion sensor for collecting motion information and a biomedical sensor for collecting physiological information. According to a signal processing sequence, whether the measurement signals meet multiple qualifying conditions for a fall incident is determined. The multiple qualifying conditions include: a condition evaluating at least the motion information, and a condition evaluating at least the physiological information. The method further includes: when the measurement signals do not meet the multiple qualifying conditions, continuing to monitor the user activities; and when the measurement signals meet the multiple conditions, determining that a fall incident has occurred, and sending an alert message to a designated contact.

Another aspect of the present disclosure provides a system for fall detection, including a plurality of sensors, one or more processor and a communication module. The sensors are configured to collect measurement signals to monitor user activities, the plurality of sensors including a motion sensor for collecting motion information and a biomedical sensor for collecting physiological information. The one or more processor is configured to: receive the measurement signals from the plurality of sensors, according to a signal processing sequence, determine whether the measurement signals meet multiple qualifying conditions for a fall incident; when the measurement signals do not meet the multiple qualifying conditions, continue to monitor the user activities; and when the measurement signals meet the multiple conditions, determine that a fall incident has occurred. The multiple qualifying conditions include: a condition evaluating at least the motion information, and a condition evaluating at least the physiological information. The communication module is configured to send an alert message to a designated contact when the fall incident has occurred.

Another aspect of the present disclosure provides a device for fall detection, including a sensor, a processor, and a communication module. The sensor may be configured to collect measurement signals to monitor user activities, the sensor being a motion sensor for collecting motion information. The processor may be configured to: receive the measurement signals from the sensor, according to a signal processing sequence, determine whether the measurement signals meet multiple qualifying conditions for a fall incident; when the measurement signals do not meet the multiple qualifying conditions, continue to monitor the user activities; and when the measurement signals meet the multiple qualifying conditions, determine that a fall incident has occurred. Further, the communication module may be configured to send an alert message to a designated contact when the fall incident has occurred. The multiple qualifying conditions may include: a condition evaluating acceleration amplitude information of the device, and a condition evaluating a reverse impact of the device.

Other aspects of the present disclosure can be understood by those skilled in the art in light of the description, the claims, and the drawings of the present disclosure.

BRIEF DESCRIPTION OF THE DRAWINGS

The following drawings are merely examples for illustrative purposes according to various disclosed embodiments and are not intended to limit the scope of the present disclosure.

FIG. 10 illustrates multiple positions of and exemplary accelerometer and corresponding data collected by the exemplary accelerometer included in the fall detection system consistent with various disclosed embodiments.

DETAILED DESCRIPTION

Reference will now be made in detail to exemplary embodiments of the invention, which are illustrated in the accompanying drawings. Hereinafter, embodiments consistent with the disclosure will be described with reference to the drawings. Wherever possible, the same reference numbers will be used throughout the drawings to refer to the same or like parts. It is apparent that the described embodiments are some but not all of the embodiments of the present invention. Based on the disclosed embodiments, persons of ordinary skill in the art may derive other embodiments consistent with the present disclosure, all of which are within the scope of the present invention.

The present disclosure provides a system and method that significantly improves the reliability of existing fall detection applications and reduces the rate of false alert. An accidental fall of a person not only introduces a series of mechanical motions of the body, but is also accompanied with certain biological and physiological signal changes, such as sudden changes in cardiac rhythm (pulse), blood pressure, body temperature, muscular tension, etc. Unlike conventional fall detection methods that rely solely on mechanical/motion signals, the disclosed system and method collects, synthesizes, and interprets both mechanical and biological signals of the body to provide additional parameters for determining the state of the body. Therefore, the robustness and reliability of fall detection can be greatly improved.

FIGS. 3-11 illustrate exemplary methods and systems for fall detection in accordance with various disclosed embodiments. The exemplary methods and systems can be implemented, for example, in an exemplary environment 100 as shown in FIG. 1.

Figure 1:
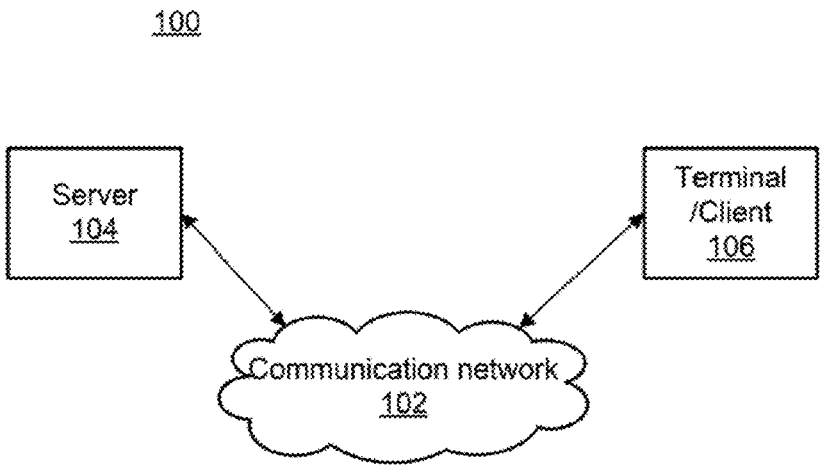
FIG. 1 illustrates an exemplary operating environment incorporating certain disclosed embodiments.

As shown in FIG. 1, the environment 100 can include a server 104, a terminal 106, and a communication network 102. The server 104 and the terminal 106 may be coupled through the communication network 102 for information exchange, for example, application update, data update, Internet searching, etc. Although only one terminal 106 and one server 104 are shown in the environment 100, any number of terminals 106 or servers 104 may be included, and other devices may also be included.

The communication network 102 may include any appropriate type of communication network for providing network connections to the server 104 and terminal 106 or among multiple servers 104 or terminals 106. For example, the communication network 102 may include the Internet or other types of computer networks or telecommunication networks, either wired or wireless.

A terminal, as used herein, may refer to any appropriate user terminal with certain computing capabilities, for example, a mobile terminal, a smart wearable device, a tablet computer, a personal computer (PC), a work station computer, a server computer, or any other user-side computing device.

A terminal (e.g., terminal 106) may include one or more clients. The client, as used herein, may include any appropriate application software, hardware, or a combination of application software and hardware to achieve certain client functionalities. For example, the client may be an app, such as a map app, a healthcare app, a social network service app, a messaging app, a video/audio communication app, etc. Further, an app may contain different contents and various app functions to provide corresponding services.

A server, as used herein, may refer one or more server computers configured to provide certain server functionalities, for example, data processing, search engines and database management. A server may also include one or more processors to execute computer programs in parallel.

Figure 2:
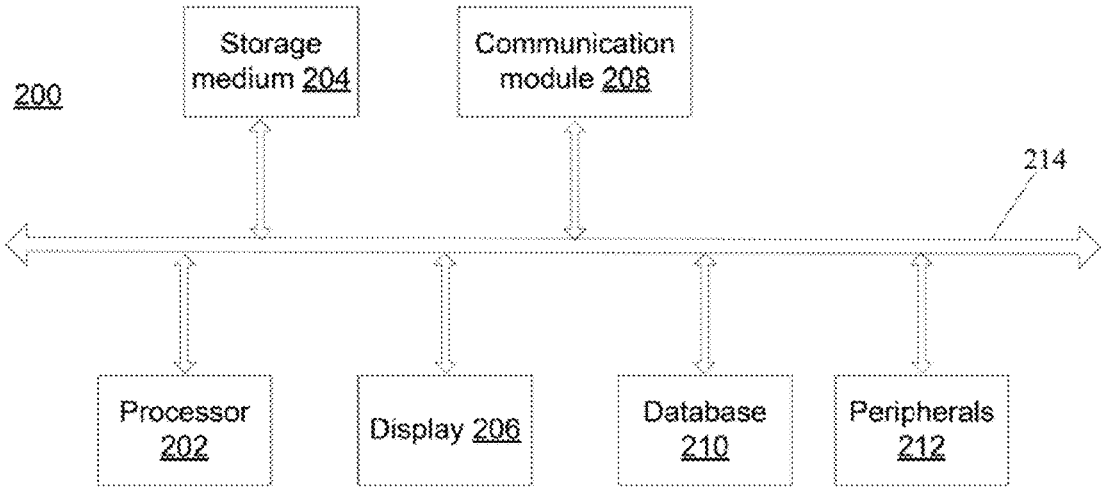
FIG. 2 illustrates a block diagram of an exemplary computer system consistent with various disclosed embodiments.

The server 104 and the terminal 106 may be implemented on any appropriate computing platform. FIG. 2 shows a block diagram of an exemplary computing system 200 capable of implementing the server 104 and/or the terminal 106. As shown in FIG. 2, the exemplary computer system 200 may include a processor 202, a storage medium 204, a display 206, a communication module 208, a database 210, peripherals 212, and one or more bus 214 to couple the devices together. Certain devices may be omitted and other devices may be included.

The processor 202 can include any appropriate processor or processors. Further, the processor 202 can include multiple cores for multi-thread or parallel processing. The storage medium 204 may include memory modules, e.g., Read-Only Memory (ROM), Random Access Memory (RAM), and flash memory modules, and mass storages, e.g., CD-ROM, U-disk, removable hard disk, etc. The storage medium 204 may store computer programs for implementing various processes (e.g., obtaining sensor data, processing sensor data according to configurations, etc.), when executed by the processor 202.

The display 206 may include display devices (e.g., CRT or LCD based devices, touch screens) for displaying contents in the computing system 200, e.g., displaying sensor data and processed data to present health status indicators of the user, displaying a user-interactive interface to collect user inputs, etc. Further, the communication module 208 may include network devices and hardware components for establishing connections through the communication network 102. For example, communication module 108 may include an adapter and an antenna for sending and receiving signals from the communication networks. The communication module 208 may further include network devices for establishing wired or wireless connections (e.g., WiFi, Bluetooth, infrared, cable) with the peripherals 212. The database 210 may include one or more databases for storing certain data and for performing certain operations on the stored data, e.g., storing user profiles, browsing history data, etc.

The peripherals 212 may include I/O devices, e.g., keyboard, mouse, camera, speaker, microphone, GPS, etc. The peripherals may also include sensors, such as motion sensors (e.g., accelerometer, gyroscope, tilt sensor), environmental sensors (e.g., ambient light sensor, temperature and humidity sensor), position sensors (e.g., proximity sensor, orientation sensor, and magnetometer), physiological sensors (e.g., heart rate sensor, blood pressure sensor, body temperature sensor, mechanomyogram sensor, electromyography sensor). Further, a wearable device (e.g., a smart watch, a smart collar/necklace, a smart headset, smart glasses, a smart ring, and a smart watch) may include one or more of the aforementioned sensors. In one embodiment, the wearable device may be considered as an I/O device of the terminal 106. In another embodiment, the wearable device may be considered as the terminal 106.

In operation, the terminal 106 (e.g., processor 202) may monitor user activities through multiple sensors (e.g., peripherals 212). The terminal 106 may be configured to provide structures and functions correspondingly for related actions and operations. More particularly, in some embodiments, the terminal 106 may record sensor data to monitor user activity, determine whether the monitored user activity is a fall incident, and inform the server 104 (e.g., via communication module 208) when the terminal 106 determines an occurrence of a fall incident. In some embodiments, the terminal 106 may record sensor data to monitor user activity, and send the recorded data to the server 104. The server 104 may determine whether the monitored user activity is a fall incident.

The setup of the disclosed fall detection system involves a plurality of electronic sensors (e.g., peripherals 212) that collect, record, and transmit relevant bio-medical data, as well as physical motions of the person. Such sensor arrays may be detached from the person, as in a context-aware system; or attached to the person as in certain wearable devices. The bio-medical and mechanical sensors may be combined or separated, placed in one casing or in separate enclosure, installed in one location or placed strategically in different parts of the environment or worn by the person in various positions. Further, sensors may be connected wired or wirelessly, locally or remotely, to a central data transmitter (e.g., processor 202 and communication module 208) that receives, stores, and transmits the sensor-collected data to another remote processor (e.g., server 104). The processor (e.g., processor 202) may apply certain algorithm to the sensor-collected data and compares both bio-medical and mechanical results to the normal value ranges of such results to determine if the person is in a fallen state.

Figure 3:
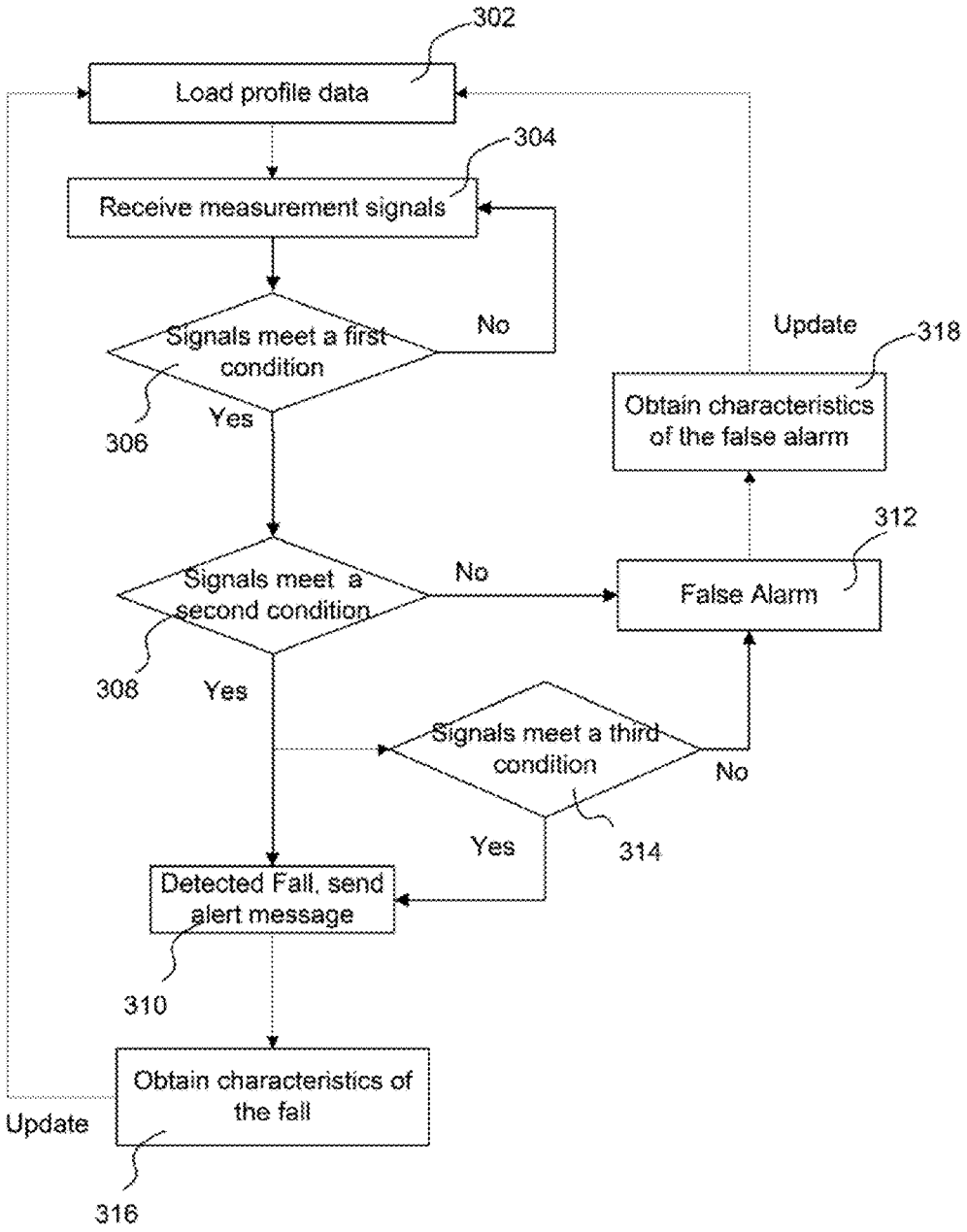
FIG. 3 illustrates a flowchart of an exemplary fall detection process consistent with various disclosed embodiments.

FIG. 3 illustrates a flowchart of an exemplary fall detection process consistent with various disclosed embodiments. As shown in FIG. 3, a terminal (e.g., terminal 106) may receive measurement signals collected by multiple sensors (S304). The multiple sensors may include one motion sensor for collecting motion information of the user, and one biomedical sensor for collecting physiological information of the user. Some measurement signals may be collected continuously, some measurement signals may be collected at a predetermined time interval, and some measurement signals may be collected when a certain condition is met. Sensors, as used herein, may refer to a device, physical or virtual, that outputs measurement signals obtained by hardware, software, or a combination of hardware and software. For example, a gravity sensor may output g-force measurement signals after processing raw signals from an accelerometer.

The terminal may further analyze the measurement signals to determine whether a potential fall has occurred according to a signal processing sequence. Configuring the signal processing sequence may include configuring multiple qualifying conditions for evaluating different aspects of the measurement signals, and deciding a particular order to investigate the measurement signals using the multiple qualifying conditions. Specifically, the terminal may determine whether the measurement signals meet a first condition (S306). When the first condition is meet, the terminal may determine that a potential fall has occurred. The first condition may be one or more threshold values corresponding to one or more data types of the measurement signals or processed measurement signals. Alternatively, the first condition may be a classification or pattern recognition result obtained by applying certain machine learning algorithms to process the measurement signals.

Using data collected by a motion sensor (e.g., an accelerometer) as an example, the first condition may be an acceleration threshold range. When the acceleration value collected by the accelerometer (e.g., in any direction or in particular directions of x, y, z axis, from a single measurement or an averaged value from multiple measurements) is within the acceleration threshold range (e.g., greater than 2 g), the terminal may determine that a potential fall has occurred; otherwise, the terminal may determine that the user is performing daily activity. Alternatively, the terminal may extract features from the collected acceleration values (e.g., from measurements collected in last two seconds), and employ pattern recognition techniques to determine a classification result. In some embodiments, data collected from previous activities of the user may be used as reference data to configure the threshold value or as training data to improve the classification results.

In one embodiment, data collected by one sensor may be processed to determine whether the potential fall has occurred. In another embodiment, data collected by two or more sensors may be processed to determine whether the potential fall has occurred.

When the measurement signals do not meet the first condition, the terminal may continue receiving measurement signals to monitor user activity (S304). When the measurement signals meet the first condition, the terminal may further decide whether the potential fall is a false alarm or an actual fall by determining whether the measurement signals meet a second condition (S308). The second condition may be one or more threshold values corresponding to one or more data types of the measurement signals or processed measurement signals. Alternatively, the second condition may be a classification or pattern recognition result obtained according to the measurement signals.

Using data collected by a heart rate (HR) sensor as an example, the second condition may be a HR threshold. When the HR exceeds the HR threshold (e.g., 120% of the normal heart rate, 70% of the maximum heart rate, increased more than 20 beats per minute during the last second), the terminal may determine that potential fall is an actual fall; otherwise, the terminal may determine that the potential fall is a false alarm. Alternatively, the terminal may extract temporal and amplitude features from the collected heart rate signals (e.g., peak value, change rate in first two second since the first condition is met, change rate in the next five seconds, difference compared to previously collected normal reading, etc.), and employ pattern recognition techniques to determine a classification result.

In some embodiments, data collected from previous activities of the user may be used as reference data to configure the threshold value or as training data to improve the classification results. For example, the terminal may obtain the normal heart rate of the user according to previous measurements, and estimate a maximum heart rate of the user according the normal heart rate and the age of the user. Further, the terminal may collect heart rate variation pattern of, for example, the user switching from a standing position to a lay down position. When the current heart rate variation pattern matches with the previously collected pattern of a normal activity, the terminal may determine that the potential fall is a false alarm.

When the measurement signals do not meet the second condition, the terminal may determine that the potential fall is a false alarm (S312). When the measurement signals meet the second condition, the terminal may determine that the potential fall is an actual fall incident (S310). When the actual fall is detected, the terminal may send an alert message to a medical center (e.g., server 104) for further instructions. The alert message may include user identification, personal information of the user (e.g., age, sex, GPS location), and characteristics of the fall incident obtained according to the measurement signals. The terminal may also send the alert to other contacts, such as a family or a friend of the user. Further, the terminal may automatically call a designated contact for emergency help.

In some embodiments, the terminal may ask whether the user is ok (e.g., by displaying a message on a screen or playing a voice message). When the user dismisses the message, the terminal may label this incident as a false alarm and return to monitor user activities (S304) without taking further actions. When the user confirms the fall, or when the terminal does not receive a response within a time duration (e.g., one minute), the terminal may perform subsequent steps and send the alert message. Further, the terminal may ask the user to record a voice or video message describing his/her situation, and the recorded message may be included in the alert message.

Further, when the terminal determines that the measurement signals meet the second condition, the terminal may further determine whether the measurement signals meet a third condition (S314). In some embodiments, the second condition may further include a first range that the terminal can confirm that the potential fall is an actual fall and a second range that the terminal need to use other type(s) of signal to further validate the result. For example, the second condition may be the heart rate exceeds 60% of the maximum heart rate for more than two seconds. The first range of the second condition may be that the heart rate exceeds 80% of the normal heart rate for more than two seconds, and the terminal may proceed to step S310 for subsequent actions. The second range of the second condition may that the heart rate is between 60% and 80% of the maximum heart rate, and the terminal may proceed to step S314 for further verification. In another example, the first range may be that the matching rate between the current heart rate variation pattern and that of a previously recorded normal daily activity is less than 40%; and the second range may be that the matching rate is between 40% to 60%.

The third condition may be one or more threshold values corresponding to one or more data types of the measurement signals. Alternatively, the third condition may be a classification or pattern recognition result obtained according to the measurement signals. When the measurement signals meet the third condition, the terminal may proceed to step S310. When the measurement signals do not meet the third condition, the terminal may determine that the incident is a false alarm and proceed to step S312.

In some embodiments, the exemplary process may further include an initialization step S302. When the fall detection system starts up, profile data may be loaded to the system. The profile data may include personal information of the user, configuration of the signal processing sequence, and previously collected measurement signals of the user. The personal information of the user may include, for example, age, sex, height, weight, preferred emergency contact, etc. The configurations of the signal processing sequence may include, for example, processing sequence of multiple types of measurement signals, thresholds or parameters for the measurement signals used in the qualifying conditions.

In some embodiments, the terminal may utilize a user-interactive interface to obtain user inputs on the personal information and signal processing configurations. Further, the terminal may record measurement signals of a normal daily activity identified by the user through the user-interactive interface. The normal daily activity may include, for example, sitting, standing, walking, running, laying down, and transitioning from one status to another. The user may perform an activity and identify the type of the performed activity on the user-interactive interface. Meanwhile, the terminal may store the corresponding measurement signals and associating the stored signals with the identified type. The stored signals may be further used to determine threshold values and as training data for classifications.

In some embodiments, when an actual fall is confirmed, the terminal may further analyze the characteristics of the measurement signals corresponding to the confirmed activity and update the profile data (S316). Further, some characteristics of the fall may be included in the alert message. For example, according to the measurement signals, the terminal may estimate a start time and an impact time of the fall. The difference between the start time and the impact time is the incident duration of the fall. The height of the fall, and the velocity of the fall (e.g., in a vertical direction) may be calculated according to the incident duration and the acceleration data. The measurement signals from the tilt sensor and gyroscope may be analyzed to determine whether it is a forward fall, a lateral fall, or a backward fall. Further, the terminal may estimate a severity level of the fall according to various characteristics of the fall. For example, a sharp change of the acceleration, a high velocity, or a short incident duration may indicate a more severe fall. A sharp increase of the heart rate when the incident happens and continued high heart rate after the incident happens may indicate a more severe fall.

Further, when a false alarm is confirmed (e.g., according to a user input), the terminal may further analyze the characteristics of the measurement signals corresponding to the confirmed activity and update the profile data (S318). For example, when the user instructs the terminal that the current incident is a false alarm, the terminal may further request the user to identify the type of activity that actually happened. The terminal may store the measurement signals of the incident and associating the stored signals with the identified type. The stored signals may be further used to determine threshold values and as training data for classifications.

In the exemplary process, the first condition, the second condition, and the third condition are criteria addressing different aspects of the monitored activity corresponding to data collected by various sensors. Among the first condition and the second condition, at least one condition evaluates measurement signals collected from a motion sensor, and at least one condition evaluates measurement signals collected from a biomedical sensor.

In one embodiment, the first condition may be threshold-based condition and the second condition may be machine learning based condition. In this way, the terminal may quickly filter through normal daily activities to recognize potential falls, and use comprehensive analysis on the filtered cases to provide accurate determination result. Introducing a third condition may further improve the accuracy by factoring in other aspects of the monitored activity.

In one embodiment, the measurement signals analyzed in steps S306, S308, and S314 may be signals collected at different times. For example, when a detected acceleration value is greater than a threshold value, the terminal determines that the first condition is met, and the corresponding time stamp is considered as t. The terminal may use measurement signals of the accelerometer and the heart rate sensor from t−1 s to t+5 s to determine whether the second condition is met. In other words, before the terminal determines whether the measurement signals meet the second condition, the terminal may continue collecting measurement signals for a certain time period when the first condition is met. In another example, the third condition may be corresponded to movement status in a time window from t+10 s to t+20 s. When continued movements are detected in the time window (e.g., the user stands up after a minor incident, grabs a remote after sitting down, continues walking after stepping down from a higher ground, etc.), the system may determine that the incident is a false alert; and when no movement or low level movements are detected in the time window (e.g., a sever fall occurred and the user cannot move), the system may determine that a fall incident has occurred. In another example, the third condition may be threshold values for blood pressure. The blood pressure sensor may be activated only when both the first condition and the second condition are met, and be idle at other times.

Figure 4:
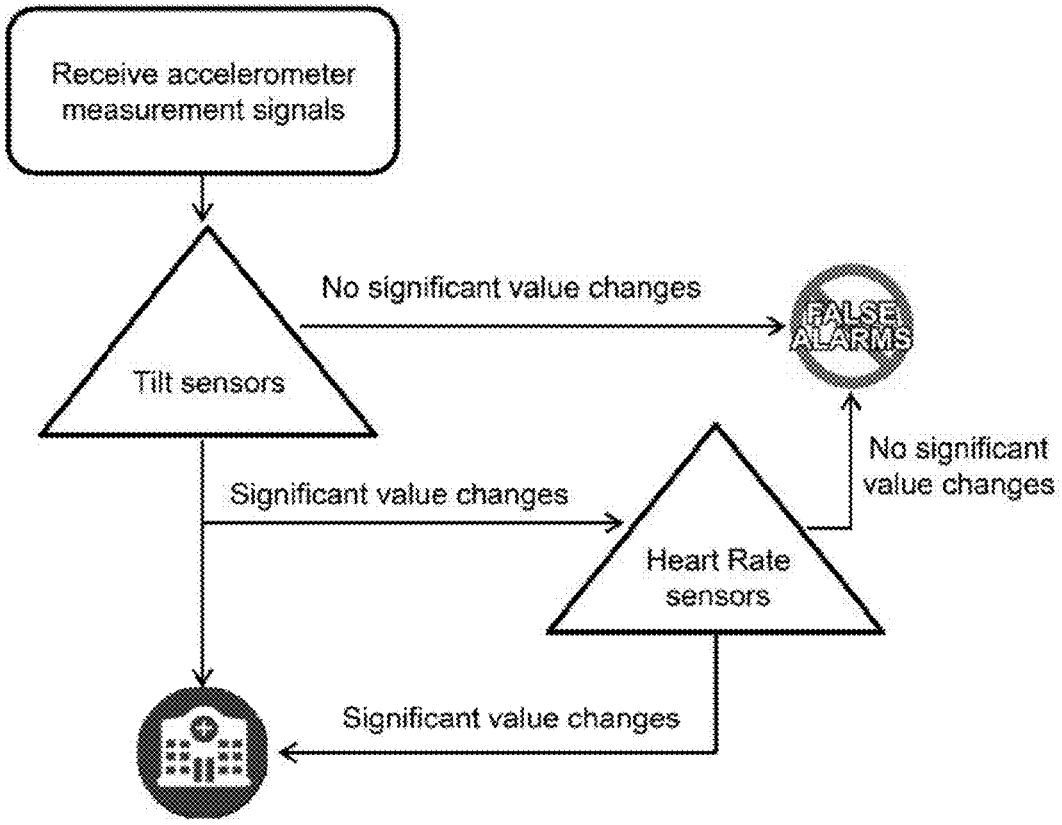
FIG. 4 illustrates a flowchart of another exemplary fall detection process consistent with various disclosed embodiments.
Figure 5:
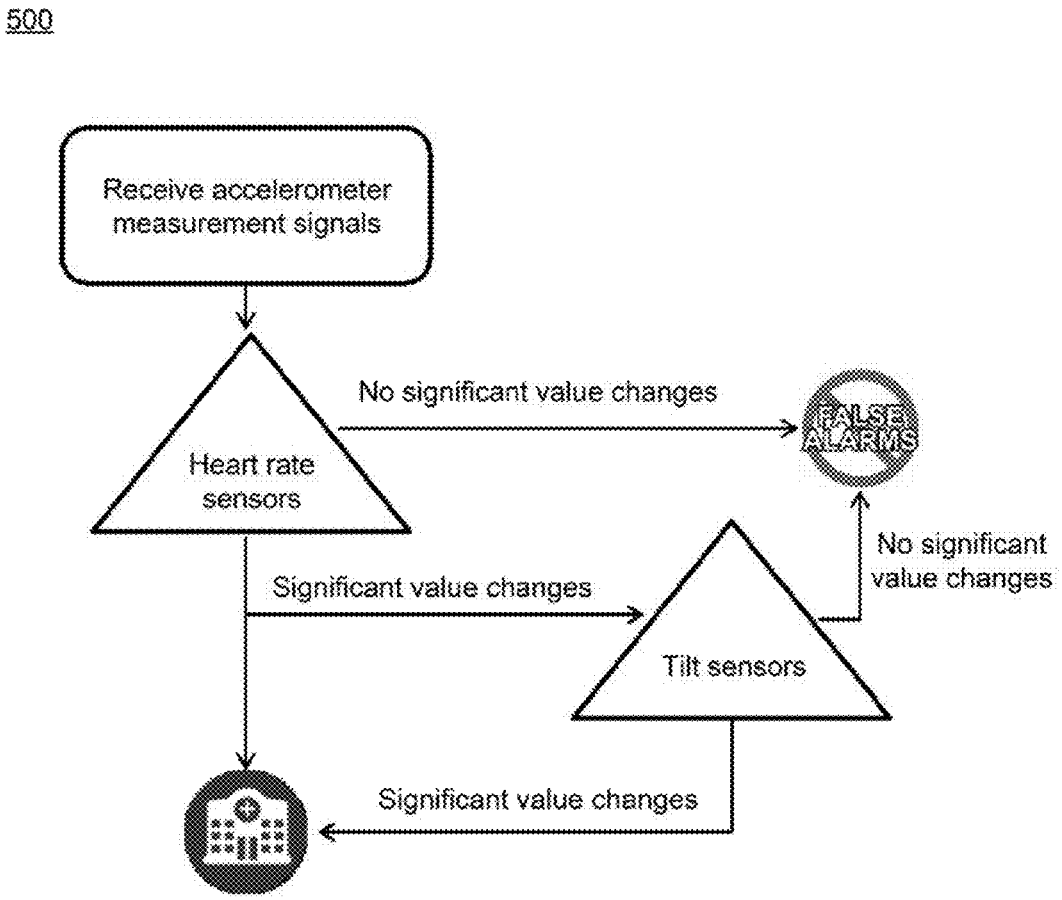
FIG. 5 illustrates a flowchart of another exemplary fall detection process consistent with various disclosed embodiments.

In some embodiments, the second condition may be exchanged with the first condition. In other words, the terminal may determine whether a potential fall has occurred according to whether the measurement signals meet the second condition, and determine whether the potential fall is an actual fall or a false alarm according to whether the measurement signals meet the first condition. Depending upon actual use cases, signals may be processed according to different sequences, as illustrated in FIG. 4 and FIG. 5. In both figures, the fall detection system may consist of three sensors: an accelerometer, a tilt sensor, and a heart rate sensor.

The system 400 as shown in FIG. 4 may primarily rely on mechanical data for fall detection and use hear rate as a verifying variable to confirm the indication of the mechanical sensors. When a fall event is signaled by the accelerometer (e.g., the first condition is met), the processor may compare the combinations of measurements from the heart rate monitoring sensors and/or the tilt sensors to detect if the monitored activity is a true fall event or a false alert. In other words, the second condition may be a threshold corresponding to a significant value changes of signals collected by the tilt sensor, and the third condition may be a threshold corresponding to a significant value changes of signals collected by the heart rate sensor.

The system 500 as shown in FIG. 5 may primarily rely on the detection of heart rate changes for fall detection and use tilt sensor to confirm the indication of the heart rate sensors. This process is slightly reversed from that in FIG. 4, in that bio-medical signal (i.e. heart rate) is given more weight in the determination of the fall event. In other words, the second condition may be a threshold indicating significant value changes of signals collected by the heart rate sensor, and the third condition may be a threshold corresponding to significant value changes of signals collected by the tilt sensor.

In either system 400 or 500, if a fall event is determined, an alert will be triggered and sent to a base stations, a mobile medical alert device, or electronics devices with wireless or in-line calling features to alert the monitoring centers, care givers, friends or 911.

In a further variation, the system and method can be used to determine the height of a fall. Specifically, by calculating the time from beginning of fall to impact, the system and method can calculate the height dropped. This information can be stored in the device for later use, such as comparing with heart rate monitoring sensors and tilt sensors to avoid false alert.

Figure 6:
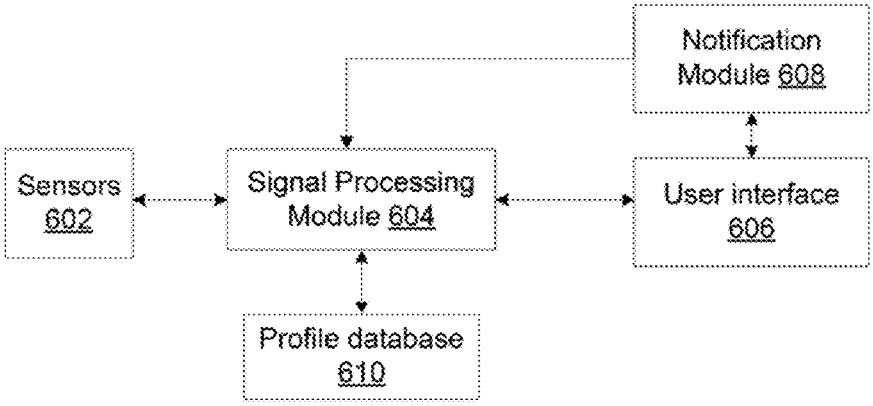
FIG. 6 illustrates a structural diagram of an exemplary fall detection system consistent with various disclosed embodiments.

FIG. 6 illustrates a structural diagram of an exemplary fall detection system consistent with various disclosed embodiments. As shown in FIG. 6, the fall detection system may include sensors 602, a signal processing module 604, a notification module 606, and a user interface 608, and a profile database 610. Certain components may be omitted and other components may be added.

Sensors 602 may be configured to obtain measurement signals of the user. The measurement signals include motion information and physiological information of the user. Sensors 602 may include at least a motion sensor and a biomedical sensor. Sensors 602 may collect real-time measurement signals and send the collected data to the signal processing module 604.

Various types of motion sensors may be used to obtain motion information of the user. For example, a video-based system having cameras deployed in a surrounding environment of the user may be applied to extract user movements and analyze user activities using the recorded video. A tri-axial accelerometer attached to the body of the user (e.g., waist, thigh, wrist, chest) may collect linear acceleration of user movement in three directions. A gyroscope may collect angular rotational velocity to indicate orientation and rotation of the body. An inertial measurement unit including the accelerometer and the gyroscope may be embedded in a smartphone, or in other types of wearable devices attached to the body. A tilt sensor may be attached to the body to detect the tilting angles of the body.

Various types of biomedical sensors may be used to obtain physiological information of the user. For example, a heart rate sensor may collect heart rate information. The heart rate sensor may include electrodes for collecting electrocardiography signals to monitor heart rate, or a light sensor for measuring light absorption by blood variated with the pulse change at, for example, the wrist and the inner ear, to monitor heart rate. The heart rate sensor may be placed in, for example, a chest strap, a smart watch, and a head phone set. A blood pressure sensor may collect systolic and diastolic blood pressure and may be placed on the wrist or the upper arm. A mechanomyogram (MMG) sensor may measure muscle activity and detect muscle contraction by a microphone or an accelerometer placed over the targeted muscle.

The profile database 610 may be configured to store user information, configurations of the signal processing sequence, previous measurement signals, characteristics of identified incidents and associations to the previous measurement signals. The profile database 610 may be implemented by a storage medium (e.g., storage medium 204, and/or database 210). The signal processing module 604 may retrieve relevant information from the profile database 610.

The signal processing module 604 may be configured to monitor the user activities by analyzing the measurement signals and determine whether the measurement signals meet multiple qualifying conditions for a fall incident according to a signal processing sequence. The signal processing sequence may include a processing order of evaluating the measurement signals using multiple qualifying conditions and parameters of the multiple qualifying conditions. The parameters of a qualifying condition may include an algorithm for processing the measurement signals and a threshold value of the processed signal.

When the measurement signals do not meet the multiple qualifying conditions, the signal processing module 604 may continue to monitor the user activities; and when the measurement signals meet the multiple conditions, the signal processing module 604 may determine that a fall incident has occurred, and send an alert message to a designated contact through the notification module 608. The signal processing module 604 may implement various embodiments according to the exemplary process shown in FIG. 3.

According to one signal processing sequence, the signal processing module 604 may determine whether the measurement signals meet a first condition. When the measurement signals meet the first condition, the signal processing module 604 may further determine whether the measurement signals meet a second condition. When the measurement signals meet the second condition, the signal processing module 604 may determine that a fall incident has occurred, and send an alert message to a designated contact through the notification module 608. When the measurement signals do not meet the first condition or the second condition, the signal processing module 604 may continue to monitor the user activities.

According to another signal processing sequence, the signal processing module 604 may determine whether the measurement signals meet a first condition. When the measurement signals meet the first condition, the signal processing module 604 may further determine whether the measurement signals meet a second condition. When the measurement signals meet the second condition, the signal processing module 604 may determine whether the measurement signals fall into a first range of the second condition or a second range of the second condition. When the measurement signals are in the first range, the signal processing module 604 may determine that the fall incident has occurred. When the measurement signals are in the second range, the signal processing module 604 may further determine whether the measurement signals meet a third condition. When the measurement signals meet the third condition, the signal processing module 604 may determine that the fall incident has occurred. When the measurement signals do not meet the first condition, the second condition, or the third condition, the signal processing module 604 may continue to monitor the user activities.

The signal processing module 604 may be implemented by one or more hardware processors. In one embodiment, the signal processing module 604 may reside on a local terminal (e.g., terminal 106) carried by the user. In another embodiment, the signal processing module 604 may reside on a remote server (e.g., server 104) that constantly receives the measurement signals (e.g., through the communication network 102) and provides determination result. In another embodiment, the signal processing module 604 may reside on both the local terminal and the remote server. For example, the local terminal may determine whether the monitored activity is a potential fall by determining whether the measurement signals meet the first condition. When the measurement signals meet the first condition, the remote server may further pull the measurement signals and analyze whether the measurement signals meet the second condition and/or the third condition. When the measurement signals do not meet the first condition, the remote server does not need to do further processing.

The user interface 606 may be configured to interact with the user, obtain user input, and communicate with the signal processing module 604. The user interface 606 may be implemented by, for example, a graphical user interface (GUI) shown on a display screen or touch screen, a set of speaker and microphone, and/or buttons/switches. The signal processing module 604 may send an instruction to the user interface 606 that requests user input (e.g., by playing a voice instruction, showing an instruction on a display screen), and the user interface 606 may forward the obtained user input (e.g., a recorded voice message from the user, a tapped virtual/physical button, a recognized hand gesture) to the signal processing module 604 for corresponding further actions.

In some embodiments, the user may configure signal processing sequence and parameters for the qualifying conditions through the user interface 606. In some embodiments, the user interface 606 may instruct the user to perform a daily activity and identify the type of the performed activity. In some embodiments, the user interface 606 may direct the user to input personal information.

In some embodiments, when the signal processing module 604 determines a fall incident, the user interface 606 may request the user to confirm the incident. For example, the user interface 606 may vibrate and/or ring for user attention, the user may stop the vibration/ringing and identify whether it is an actual fall or a false alarm, and whether the user needs emergency help. When it is a false alarm, the user interface 606 may further ask the user to identify what type of normal activity the user was doing so that the signal processing module 604 may associate corresponding measurement signals with the identified activity as a reference for future prediction. When the user does not provide any response within a certain time period (e.g., a minute) after the user interface 606 requests user attention, the signal processing module 604 may automatically instruct the notification module 608 to call for emergency help. When the signal processing module 604 does not detect a fall, the user may directly require emergency help through the user interface 606 (e.g., using a shortcut button).

Figure 7:
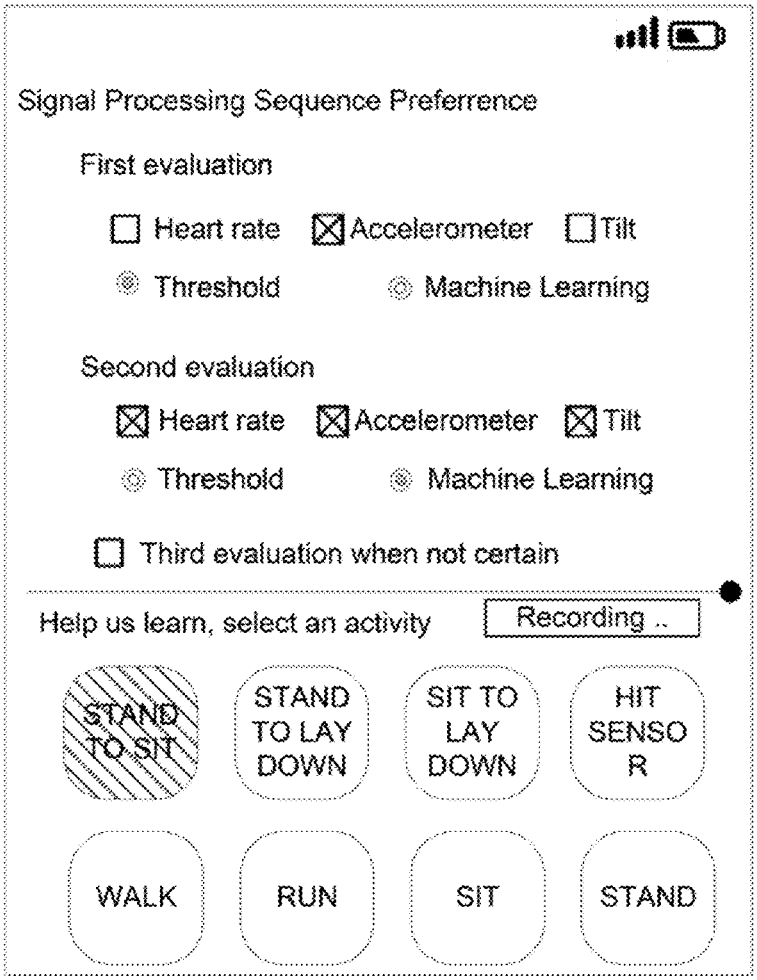
FIG. 7 illustrates a screen of an exemplary graphical user interface of the fall detection system consistent with various disclosed embodiments.

FIG. 7 illustrates a screen of an exemplary graphical user interface of the fall detection system consistent with various disclosed embodiments. As shown in FIG. 7, a configuration page may allow the user to select preferred signal processing sequence and preferred method to process the measurement signals. Further, the GUI may guide the user to perform a normal activity and identify the activity type, the corresponding measurement signals may be stored in the profile database 610. The signal processing module 604 may analyze the corresponding measurement signals and update parameters of the qualifying condition.

The notification module 608 may be configured to communicate with designated contacts when the signal processing module 604 determines that a fall incident occurred. The notification module 608 may be implemented by network devices for establishing wired or wireless connections (e.g., communication module 208).

The signal processing module 604 may compose an alert message and inform the notification module 608 to send the alert message to a designated contact (e.g., a medical center, a family, a friend). The alert message may include personal information of the user (e.g., name, age, sex), position information (e.g., GPS location) and information corresponding to the fall incident. The information corresponding to the fall incident may be at least one of: part or all of the collected measurement signals corresponding to the fall incident, the severity of the fall determined by the signal processing module 604 or identified by the user, the height of the fall, a recorded message from the user or a nearby help describing the fall incident and current situation, a picture of the scene automatically or manually captured, etc.

In some embodiments, a medical center or a server may update configurations for determining a fall incident according to analysis of previous measurement signals of the user, and change user interface designs for updated functionalities. The notification module 608 may receive the updated configurations and/or the user interface designs, and update the profile database 610 and or the user interface 606 accordingly.

In operation, the sensors 602 may collect measurement signals and send to the signal processing module 604. The signal processing module 604 may analyze the measurement signals and recognize a fall incident according to the measurement signals and information from the profile database 610. The user interface 606 may interact with the user to provide instructions and obtain user input related to the fall incident or other user activities. When a fall incident is confirmed, the notification module 608 may send an alert message to designated contacts.

In one application example, the fall detection system 600 may include a smart phone and a headphone set. The smart phone may include an accelerometer, a gyroscope, a GPS sensor, and a communication module. The headphone set may be connected to the smart phone via Bluetooth. A tilt sensor and a heart rate sensor may be embedded in the headphone set. The smart phone may receive measurement signals from the accelerometer, the heart rate sensor and the tilt sensor, and determine whether a fall incident has occurred according to the measurement signals. The smart phone may be installed with a user activity monitor app. The app may include graphical user interface that allows the user to input personal information and emergency contact, set signal processing sequence, set parameters for qualifying conditions, and identify normal daily activity. Such information may be stored in the phone memory or uploaded to a remote server through the internet.

In the signal processing sequence, the first condition may be a threshold for the amplitude of the accelerometer signals, and a threshold for the heart rate change. When the measurement signals meet the first condition, the smart phone may wait five seconds to determine whether the measurement signals collected in the last seven seconds meet the second condition. The second condition may be a classification result of a machine learning algorithm applied to the accelerometer signals, the gyroscope signals, the tilt sensor signals, and the heart rate signals collected in the last seven seconds. Temporal and magnitude features may be extracted, such as peak values, peak duration, estimated velocity in three directions, angular change rate, averaged angle after incident, tilted degree, etc. Machine learning algorithms (e.g., neuron network, k-nearest neighbor, support vector machine) may be applied to obtain a pattern recognition or a classification result. In some embodiments, the classification result may include two categories: false alarm and true fall. In some embodiments, the classification result may include three categories: false alarm, true fall, and uncertain. When the classification result is uncertain, the smart phone may further determine whether the measurement signals meet the third condition.

When the smart phone determines that a fall incident has occurred, the smart phone may play a voice message through the headphone set asking the user to confirm whether a fall incident has occurred. The app may be activated and display a confirmation screen. The user may respond by speaking or tapping the confirmation screen. When a fall is confirmed by the user or no response within a time period, the smart phone may automatically send an alert message to the designated emergency contact. The user may stop the smart phone from communicating with the emergency contact by selecting a false alarm option displayed in the app. The app may further ask the user to select a type of activity that the user performed and store the association with the collected measurement signals as training data for future classification.

In another application example, the fall detection system 600 may include a smart watch and a wearable device designed to be mounted on the waist. The smart watch may include a heart rate sensor, a blood pressure sensor, an accelerometer, and a communication module. The waist device may include an accelerometer and a gyroscope. The smart watch may receive signals collected by the waist device, and send the received signals and other measurement signals collected by the heart rate sensor, the blood pressure sensor, and the accelerometer to a remote server.

Specifically, the first condition may be a threshold of the heart rate value change. When the smart watch detects that the first condition is met, the smart watch may send the measurement signals of the heart rate sensor, the accelerometer in the watch, and the accelerometer in the waist device to the remote server. The remote server may analyze such measurement signals comprehensively to determine whether the second condition is met. When the measurement signals meet the second condition, the remote server may instruct the smart watch to automatically take a blood pressure reading using the blood pressure sensor. The third condition may be a threshold of blood pressure difference. The smart watch may calculate the difference between the current reading and a normal reading (e.g., previously taken and recorded) and determine whether the third condition is met. When the third condition is met, the smart watch may notify the server for further actions.

In another application example, the fall detection system 600 may include a smart pendant. The smart pendant may be attached to a necklace or a collar for the user to wear. The smart pendant may include a motion sensor (e.g., accelerometer), a microcontroller unit (MCU), and a communication module.

Specifically, when the device is in use, the MCU may be in a sleep mode to conserve power. The motion sensor may continuously detect accelerations of the device and write the acceleration data to memory. When a value of the motion signal is less than a preset amplitude threshold (e.g., no potential fall movement), the value in the memory may be overwritten by new data recorded by the motion sensor. When an amplitude value is equal to or greater than 0.25 g, the motion sensor may send an interrupt signal to wake up the MCU (i.e., enter an active mode). In the active mode, data collected by the motion sensor are kept and saved in the memory, and MCU performs further analysis to determine whether the qualifying conditions are met according to subsequent signals from the sensor.

The first condition may include an amplitude threshold and a quantity threshold N. The MCU may obtain M amplitude readings from the motion sensor by polling; count a number of readings that are below the amplitude threshold among the M amplitude readings, where M and N are preset positive integers and N is less than M; determine whether the counted number is above the quantity threshold N; and when the counted number is above the quantity threshold, determine that the condition evaluating the acceleration amplitude information of the device is satisfied.

For example, after being awaken, the MCU may inquire gravity status of the gravity sensor every 1 ms by polling.

When a gravity status is 0 (i.e., when the acceleration in the vertical direction is 1 g), it indicates that a free fall has occurred. The threshold for the gravity data in the second condition may be 200. In other words, when the absolute value at one or more of the x-axis, y-axis, and z-axis is below 200, it may be determined that the pendant is free falling. Multiple readings (e.g., 20) may be polled by the MCU, and when the value being lower than 200 occurs more than a preset number (e.g., 2 readings are below the threshold), it may be determined that a fall incident is occurred to the user. Otherwise, the system may determine that it is a false alert and the MCU may enter sleep mode until next wake by an interrupt from the register.

In some embodiments, the first condition may further include a fall distance threshold. The fall distance threshold may be a preset default value (e.g., 0.4 m). Alternatively, the fall distance threshold may be a value dynamically adjusted based on the user's height information. For example, a greater threshold value may be set for a user having a higher stature. The fall distance may be calculated by the MCU according to the amplitude of the accelerometer data and temporal information. In other words, when two readings of accelerometer values are less than the accelerometer threshold and the calculated fall distance is greater than the distance threshold, the second condition is met.

In some embodiments, the second condition may be a status of whether a reverse impact has happened, or a specific signal pattern of positive and negative sign occurrences; and. Due to the way a user wears the smart pendant, a fall incident may cause the pendant to bounce at the moment a user hits the ground or experiences a sudden movement stop. Such bounce activity may be referred to as a reverse impact. The reverse impact may be reflected in the gravity data with a distinctive pattern. The pattern may generally include, in a chronological order, positive values (e.g., a fall occurs), negative values (e.g., the reverse impact occurs immediately afterwards), and nearly zero values (e.g., the pendant stops bouncing and rests). Pattern recognition techniques may be employed to determine whether the reverse impact has occurred. The MCU may compare a signal pattern of the motion information collected in a time window starting a time the interrupt is generated, with the specific signal pattern; and when the collected signal pattern matches with the specific signal pattern, determine that the condition evaluating the reverse impact of the device is satisfied. In this way, the status of whether a reverse impact has happened may be determined. When the second condition is met, the system may determine that a fall incident has occurred.

In some embodiments, the third condition may be movement status in a delayed time window after the initial detection of the fall incident. The delayed time window may be from t+10 s to t+20 s, t being the moment that the MCU is waken. When continued movements are detected in the time window (e.g., the user stands up after a minor incident, grabs a remote after sitting down, continues walking after stepping down from a higher ground, etc.), the system may determine that the incident is a false alert; and when no movement or low level movements are detected in the time window (e.g., a sever fall occurred and the user cannot move), the system may determine that a fall incident has occurred. The movement level may be reflected by amplitudes of acceleration data in three axis directions.

When the system determines an occurrence of a fall incident, an alert message may be generated and the communication module may automatically contact a remote server or an emergency number to help the user. In some embodiments, the alert message may include a GPS location of the pendant.

In some embodiments, the communication module may send collected user data to the remote server for further analysis. The user data may include data collected from the time point that the MCU enters the active mode until the time point that the MCU confirms a fall incident and instructs the communication module to send out the alert message. When the alert message is sent, an informed call center or care giver may contact or locate the user and provide emergency help. In case of a false alert, the call center may also record such event.

The remote server may collect and analyze fall incident data of all users and adjust parameters in the qualifying conditions used by the MCU through the communication module. The remote server may verify with the call center and label the received user data as true positive or false positive. As the database of fall incident builds up, the remote server may have more suitable parameters for the qualifying conditions and the accuracy of fall detection may be increased. For example, the remote server may determine different fall distance thresholds for different groups (e.g., age group, sex group, groups having different height/weight ranges) according to the collective data. In another example, the remote server may develop an estimate equation for the fall distance using a fitting algorithm. The variables may be height and weight of a user. Parameters of the estimation equation may be obtained by applying the fitting algorithm to the user data with known heights and weights. Afterwards, a fall distance threshold for a new user may be obtained by substituting his/her height and weight to the estimation equation.

When a parameter of one qualifying condition for one or more user group is updated in response to a recent collected user data, the remote server may update configurations of the smart pendants in the user group in real time. For example, when the number of motion information data of various users (all users or one user group) reaches 100, the server may perform a collective analysis on the motion information data and update the parameters.

In some embodiments, a specific range of the accelerometer data may be acquired and amplified for further analysis. The specific range may be a data range of interest which is most sensitive for fall detection. For example, a commercially available accelerometer may detect accelerations in the range of ±8 g. When this accelerometer is used in the smart pendant, the MCU may acquire acceleration data in the specific range of −2 g to +2 g. Further, the MCU may further amplify the acquired data and process the amplified data to determine whether one or more qualifying condition is met by software means.

Figure 8:
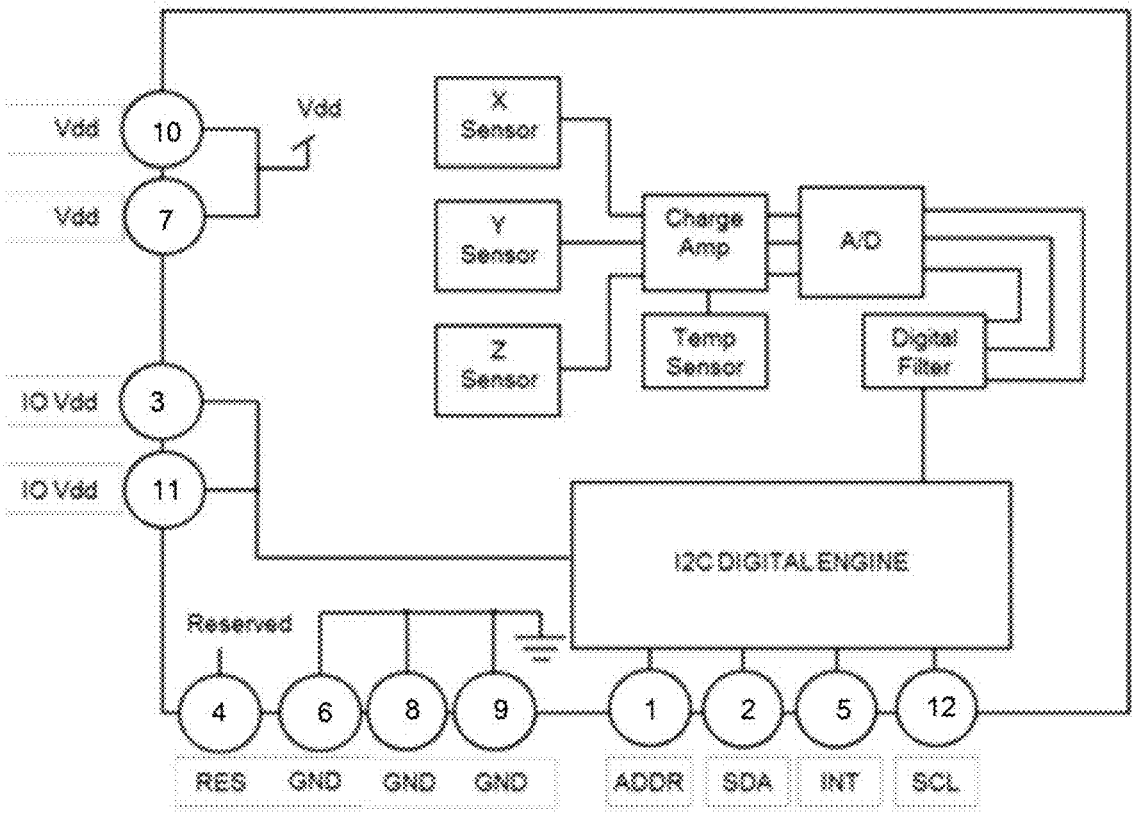
FIG. 8 illustrates a structural diagram of an exemplary accelerometer included in the fall detection system consistent with various disclosed embodiments.

Specifically, FIG. 8 illustrates a structural diagram of an exemplary accelerometer included in the fall detection system consistent with various disclosed embodiments. As shown in FIG. 8, analog signals collected by X, Y, Z sensors are converted to digital signals by A/D convertor. For example, the exemplary accelerometer may be a tri-axis silicon micromachined accelerometer with multiple working ranges including ±2 g, ±4 g, and ±8 g. The working range may be configured by its register setting. The digital signal range of the accelerometer is from −2048 to +2048 when A/D convertor work at 12 bit. The digital signal range remains the same regardless of the work range +/−2 g, +/−4 g or +/−8 g. That is, for a same acceleration change, digital signal variations in the +/−2 g work mode is greater than that in the +/−4 g mode. In other words, the smaller the work range is, the higher the accuracy is. In one embodiment, as the value of acceleration in fall detection is generally smaller than 2 g generally, the work range of the gravity sensor (i.e., the accelerometer) may be set as +/−2 g.

Figure 9:
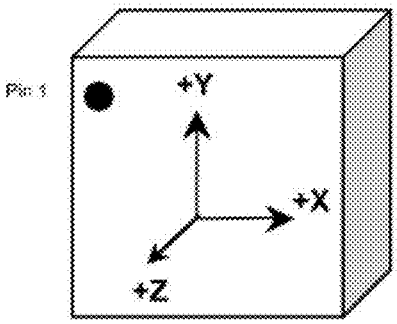
FIG. 9 illustrates an exemplary coordinate system of an exemplary accelerometer included in the fall detection system consistent with various disclosed embodiments.

FIG. 9 illustrates an exemplary coordinate system of an exemplary accelerometer included in the fall detection system consistent with various disclosed embodiments. As shown in FIG. 9, a motion sensor may record acceleration data in three directions, x-axis, y-axis, and z-axis. When the device is accelerated in +X, +Y, or +Z direction, the corresponding output increases. The y-axis direction may be referred to as the gravity direction. In some embodiments, most qualifying conditions for fall detection may only use the acceleration data in the gravity direction, as a free fall may always reflect in the gravity direction no matter it is a forward fall or a backward fall. The only qualifying condition that evaluates the acceleration data in all three axes may be the condition relating to the movement level in the delayed time window, since any sorts of movements may suggest that the user did not fall or had a light fall and is still capable of moving around.

FIG. 10 illustrates multiple positions of and exemplary accelerometer and corresponding data collected by the exemplary accelerometer included in the fall detection system consistent with various disclosed embodiments. When the accelerometer is placed at different positions at rest (no movement), corresponding amplitude and polarity outputs in X/Y/Z directions are shown in FIG. 10. When the A/D convertor (e.g., shown in FIG. 8) has a resolution of 12 bit, the non-zero output values in these positions are either 1024 or −1024. This number reflects the gravity of the earth. When a free fall occurs, the theoretical values of x, y, z directions are zero. In practical testing, the digital values of xyz axes varied between 100 to 200. This may happen due to some factors such as air resistance and machine rotation. In some embodiments, the threshold value of a condition evaluating digital acceleration data of free fall may be set as 200 (about 0.4 g). When the absolute value of a digital output form the accelerometer is less than 200, the system may determine a free fall has occurred.

Figure 11:
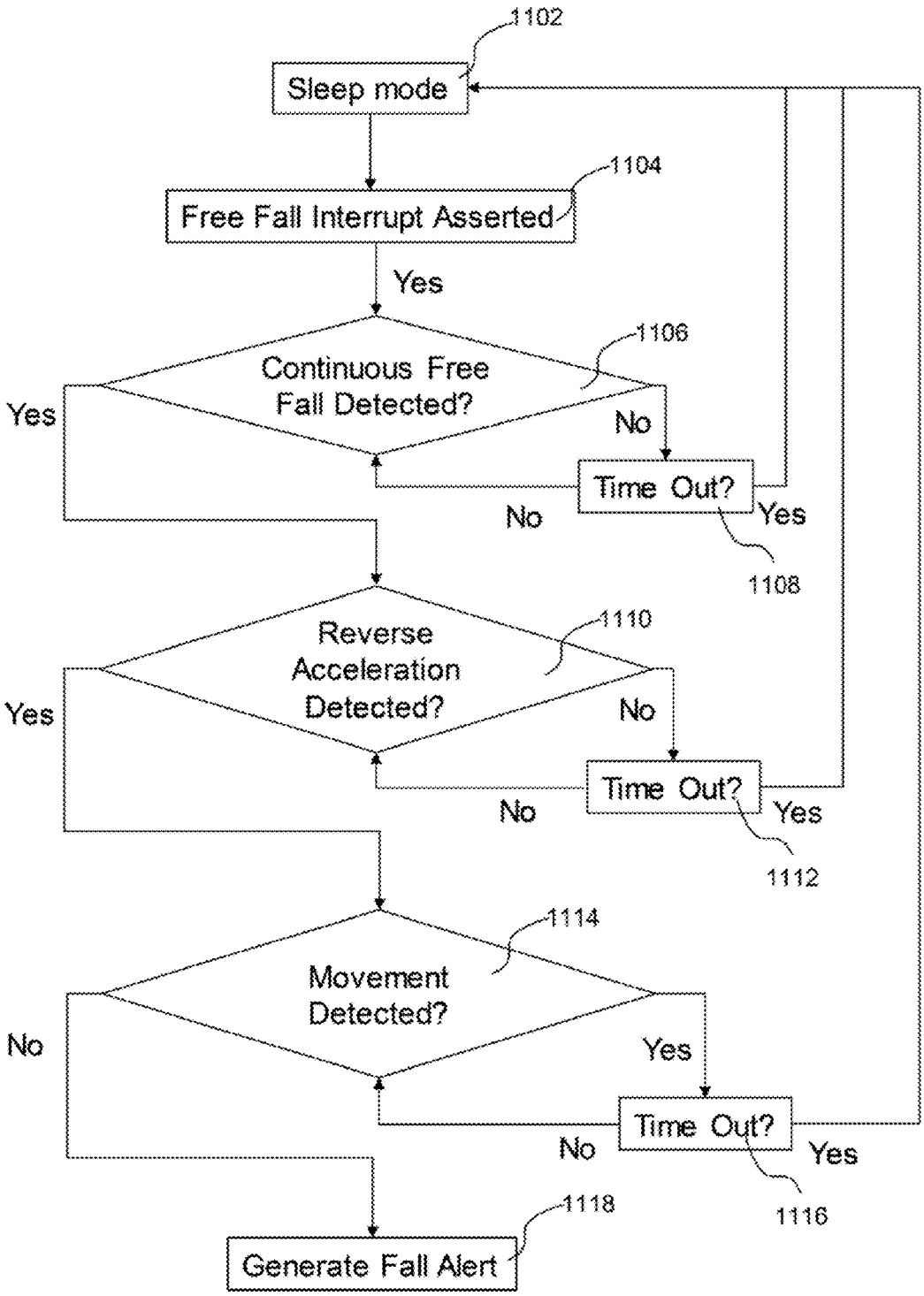
FIG. 11 illustrates a flowchart of another exemplary fall detection process consistent with various disclosed embodiments.

FIG. 11 illustrates a flowchart of another exemplary fall detection process consistent with various disclosed embodiments. The signal processing sequence in the fall detection process may include sequentially evaluating: 1) occurrence of free fall, 2) a backward acceleration produced by the device knocking against the earth, and 3) a continuous non-movement time duration.

Specifically, as shown in FIG. 11, when the device is stationary, the gravity sensor monitors the acceleration data and the MCU is in sleep mode (S1102). A threshold for an interrupt register of the accelerometer (i.e., gravity sensor) may be preset (e.g., 0.5 g). When the change of acceleration is greater than 0.5 g, the gravity sensor may produce an interrupt signal to wake up the MCU (S1104). In one example, the interrupt registers of the accelerometer may be configured to have ±0.5 g threshold and 30 ms duration time.

When awake, the MCU may continuously read real-time data from the gravity sensor and determine whether the received data meet the qualifying conditions according to the signal processing sequence. Parameters such as a first amplitude threshold, a quantity threshold, and a first time duration may be preset for a first condition. MCU may determine whether a continuous free fall is detected according to the first condition (S1106). When there are at least a number of readings (e.g., 3) in the following received data (e.g., next 1 second) below the first amplitude threshold (e.g., digital value 200), MCU may determine that the first condition is met. When MCU determines the received data match the first condition, the process may continue to determine whether the received data meet a second condition (S1108). When the first condition is not met yet and the first time duration is not passed (i.e., not timed out), MCU may continue to determine whether the received data meet the first condition (S1106). When the first condition is not met and it is timed out, MCU may enter the sleep mode (S1102).

Further, MCU may determine whether a reverse acceleration (i.e. reverse impact) is detected according to the second condition (S1110). Parameters such as a second amplitude threshold, and a second time duration may be preset for the second condition. When one or more amplitude values of negative X, Y, Z axes data (e.g., within 500 ms after MCU confirms the first condition is met) is greater than the second amplitude threshold, or when a sharp change in the acceleration data in the second time duration occurs in the negative direction and having a range greater than the second amplitude threshold (e.g., 2 g), MCU may determine that the second condition is met, and continues to step S1114. When the second condition is not met yet and the second time duration is not passed (i.e., not timed out), MCU may continue to determine whether the received data meet the second condition (S1110). When the second condition is not met and it is timed out, MCU may enter the sleep mode (S1102).

When the reversed acceleration is detected, MCU may determine whether a movement is detected according to a third condition (S1114). Parameters such as a time threshold, and a third time duration may be preset for the third condition. When a continuous non-movement time duration greater than the time threshold (e.g., 10 s) is detected before the third time duration run out (e.g., 20 s), MCU may determine that the third condition is met and a fall incident happens. MCU may further generate a fall alert (S1118). When the third condition is not met yet and the third time duration is not passed (i.e., not timed out), MCU may continue to determine whether the received data meet the third condition (S1116). When the third condition is not met and it is timed out, MCU may enter the sleep mode (S1102).

The present disclosure provides a system and method that significantly improves the reliability of existing fall detection applications and reduces the rate of false alert. This system and method includes a plurality of electronic sensors that collect, record, and transmit relevant bio-medical data, as well as physical motions of the person. The sensor arrays are connected to a central data transmitter that transmits the sensor-collected data to another remote processor. The processor then applies certain algorithm to the data and compares both bio-medical and mechanical results to the normal value ranges of such results to determine whether the person is in a fallen state.

It should be noted that, the disclosed method and system may be used for not only a fall detection, but also other body movement detection, such as exercise monitoring, rehabilitation activity monitoring, etc.

Other embodiments of the disclosure will be apparent to those skilled in the art from consideration of the specification and practice of the invention disclosed herein. It is intended that the specification and examples be considered as exemplary only, with a true scope and spirit of the invention being indicated by the claims.

What is claimed is:

1. A method for fall detection, comprising:

receiving measurement signals from a plurality of sensors to monitor user activities, the plurality of sensors including a motion sensor for collecting motion information and a biomedical sensor for collecting physiological information;

according to a signal processing sequence, determining whether the measurement signals meet multiple qualifying conditions for a fall incident;

when the measurement signals do not meet the multiple qualifying conditions, continuing to monitor the user activities; and when the measurement signals meet the multiple qualifying conditions, determining that a fall incident has occurred, and sending an alert message to a designated contact;

wherein the multiple qualifying conditions include: a condition evaluating at least the motion information, and a condition evaluating at least the physiological information, wherein the condition evaluating acceleration amplitude information of the device includes an amplitude threshold and a quantity threshold N, and the method further comprises:

obtaining M absolute values of amplitude readings in a gravity direction from the sensor by polling;

counting a number of absolute values that are below the amplitude threshold among the M amplitude readings, wherein M and N are preset positive integers and N is less than M;

determining whether the counted number is above the quantity threshold N; and when the counted number is above the quantity threshold, determining that the condition evaluating the acceleration amplitude information of the device is satisfied.

2. The method according to claim 1, wherein according to the signal processing sequence, determining whether the measurement signals meet multiple qualifying conditions for the fall incident further includes:

determining whether the measurement signals meet a first condition;

when the measurement signals meet the first condition, determining whether the measurement signals meet a second condition;

when the measurement signals meet the second condition, determining that the fall incident has occurred; and when the measurement signals do not meet one of the first condition and the second condition, continuing to monitor the user activities;

wherein one of the first condition and the second condition evaluates at least the motion information, and another one of the first condition and the second condition evaluates at least the motion information.

3. The method according to claim 2, wherein:

the second condition further includes a first range and a second range;

when the measurement signals meet a second condition, determining that the fall incident has occurred further includes:

determining whether the measurement signals are in the first range of the second condition;

when the measurement signals are in the first range of the second condition, determining whether the measurement signals meet a third condition;

when the measurement signals meet one of: the third condition and the second range of the second condition, determining that the fall incident has occurred; and when the measurement signals do not meet the third condition, continuing to monitor the user activities.

4. The method according to claim 1, wherein:

the alert message includes a user identification, a location of the fall incident, and characteristics of the fall incident obtained according to the measurement signals.

5. The method according to claim 1, further comprising:

when the occurrence of the fall incident is determined, evaluating a severity level of the fall according to the measurement signals, and including the evaluated severity level in the alert message.

6. The method according to claim 5, wherein evaluating a severity level of the fall further comprises:

according to the collected motion information in the measurement signals, calculating a velocity of the fall and a height of the fall;

according to the collected physiological information in the measurement signals, calculating change rates of a physiological indicator during and after the fall incident; and based on the velocity of the fall, the height of the fall and the change rates of the physiological indicator, evaluating the severity level of the fall.

7. The method according to claim 1, further comprising:

providing a user interface to obtain user input on a monitored activity;

obtaining an activity type identified through the user interface;

analyzing the measurement signals corresponding to the identified activity type; and updating at least one of the first condition and the second condition according to the analyzed result corresponding to the identified activity type.

8. A system for fall detection, comprising:

a plurality of sensors configured to collect measurement signals to monitor user activities, the plurality of sensors including a motion sensor for collecting motion information and a biomedical sensor for collecting physiological information;

one or more processor configured to:

receive the measurement signals from the plurality of sensors, according to a signal processing sequence, determine whether the measurement signals meet multiple qualifying conditions for a fall incident;

when the measurement signals do not meet the multiple qualifying conditions, continue to monitor the user activities; and when the measurement signals meet the multiple qualifying conditions, determine that a fall incident has occurred, and a communication module configured to send an alert message to a designated contact when the fall incident has occurred;

wherein the multiple qualifying conditions include: a condition evaluating at least the motion information, and a condition evaluating at least the physiological information, wherein the condition evaluating acceleration amplitude information of the device includes an amplitude threshold and a quantity threshold N, and the one or more processor is configured to:

obtain M absolute values of amplitude readings in a gravity direction from the sensor by boning;

count a number of absolute values that are below the amplitude threshold among the M amplitude readings, wherein M and N are preset positive integers and N is less than M;

determine whether the counted number is above the quantity threshold N; and when the counted number is above the quantity threshold, determine that the condition evaluating the acceleration amplitude information of the device is satisfied.

9. The system according to claim 8, wherein the one or more processor is further configured to:

determine whether the measurement signals meet a first condition;

when the measurement signals meet the first condition, determine whether the measurement signals meet a second condition;

when the measurement signals meet the second condition, determine that the fall incident has occurred; and when the measurement signals do not meet one of the first condition and the second condition, continue to monitor the user activities;

wherein one of the first condition and the second condition evaluates at least the motion information, and another one of the first condition and the second condition evaluates at least the motion information.

10. The system according to claim 9, wherein:

the second condition further includes a first range and a second range;

the one or more processor is further configured to:

determine whether the measurement signals are in the first range of the second condition;

when the measurement signals are in the first range of the second condition, determine whether the measurement signals meet a third condition;

when the measurement signals meet one of: the third condition and the second range of the second condition, determine that the fall incident has occurred; and when the measurement signals do not meet the third condition, continue to monitor the user activities.

11. The system according to claim 8, wherein:

the alert message includes a user identification, a location of the fall incident, and characteristics of the fall incident obtained according to the measurement signals.

12. The system according to claim 8, wherein the one or more processor is further configured to:

when the occurrence of the fall incident is determined, evaluate a severity level of the fall according to the measurement signals, and include the evaluated severity level in the alert message.

13. The system according to claim 8, further comprising:

a user interface configured to obtain a user configuration on the signal processing sequence.

14. A device for fall detection, comprising:

a sensor configured to collect measurement signals to monitor user activities, the sensor being a motion sensor for collecting motion information;

a processor configured to:

receive the measurement signals from the sensor, according to a signal processing sequence, determine whether the measurement signals meet multiple qualifying conditions for a fall incident;

when the measurement signals do not meet the multiple qualifying conditions, continue to monitor the user activities; and when the measurement signals meet the multiple qualifying conditions, determine that a fall incident has occurred, and a communication module configured to send an alert message to a designated contact when the fall incident has occurred;

wherein the multiple qualifying conditions include: a condition evaluating acceleration amplitude information of the device, and a condition evaluating a reverse impact of the device;

wherein:

the sensor is further configured to determine a measurement signal reaches an amplitude threshold, and generate an interrupt to wake the processor from a sleep mode to an active mode; and the processor is further configured to:

in the active mode, receive the measurement signals from the sensor, according to the signal processing sequence, determine whether the measurement signals meet a first condition in the multiple qualifying conditions in a first time duration corresponding to the first condition;

when the first time duration is not passed and the first condition is met, determine whether the measurement signals meet a second condition in the multiple qualifying conditions in a second time duration corresponding to the second condition according to the signal processing sequence;

when the first time duration is not passed and the first condition is not met, continue to determine whether the measurement signals meet the first condition; and when the first time duration is passed and the first condition is not met, enter the sleep mode.

15. The device according to claim 14, wherein the condition evaluating acceleration amplitude information of the device includes an amplitude threshold and a quantity threshold N, and the one or more processor is configured to:

obtain M absolute values of amplitude readings in a gravity direction from the sensor by polling;

count a number of absolute values that are below the amplitude threshold among the M amplitude readings, wherein M and N are preset positive integers and N is less than M;

determine whether the counted number is above the quantity threshold N; and when the counted number is above the quantity threshold, determine that the condition evaluating the acceleration amplitude information of the device is satisfied.

16. The device according to claim 14, wherein:

the condition evaluating the reverse impact of the device includes a specific signal pattern of positive and negative sign occurrences; and the one or more processor is configured to:

compare a signal pattern of the motion information collected in a time window starting a time the interrupt is generated, with the specific signal pattern; and when the collected signal pattern matches with the specific signal pattern, determine that the condition evaluating the reverse impact of the device is satisfied.

17. The device according to claim 14, wherein:

the condition evaluating acceleration amplitude information of the device includes a preset movement level for a delayed time window, the delayed time window being started after the interrupt is generated for a preset time; and the one or more processor is configured to:

obtain multiple readings from the sensor by polling during the delayed time window;

determine whether one or more of the multiple amplitude readings reaches the preset movement level; and when the one or more of the multiple amplitude readings reaches the preset movement level, determine that a false alert is generated and enter the sleep mode.

18. The device according to claim 14, wherein the device is a smart pendant attached to a necklace or a collar.

19. The device according to claim 14, wherein:

the communication module is further configured to send the motion information to a remote server, and receive one or more parameters of the qualifying conditions from the remote server; and the one or more processor is further configured to: update the one or more parameters of the qualifying conditions;

wherein the remote server sends the one or more parameters of the qualifying conditions based on analysis of the motion information collected from a plurality of the devices for fall detection.

* * * * *